US007730850B2

(12) United States Patent
Khoury et al.

(10) Patent No.: US 7,730,850 B2
(45) Date of Patent: Jun. 8, 2010

(54) SURFACE ROTATION SPEED DETECTION IN SPRAY SYSTEMS

(75) Inventors: James Khoury, Strongsville, OH (US); Drew Roberts, Concord, OH (US); Lenzie Borders, Cleveland Heights, OH (US); Charles Nagy, North Ridgeville, OH (US); Timothy Wilson, Wakeman, OH (US)

(73) Assignee: Nordson Corporation, Westlake, OH (US)

( * ) Notice: Subject to any disclaimer, the term of this patent is extended or adjusted under 35 U.S.C. 154(b) by 875 days.

(21) Appl. No.: 10/990,103

(22) Filed: Nov. 15, 2004

(65) Prior Publication Data

US 2005/0160980 A1 Jul. 28, 2005

Related U.S. Application Data

(63) Continuation-in-part of application No. PCT/US03/14681, filed on May 12, 2003.

(60) Provisional application No. 60/378,008, filed on May 13, 2002.

(51) Int. Cl.
*B05C 11/10* (2006.01)

(52) U.S. Cl. ..... 118/668; 118/679; 118/686; 118/713

(58) Field of Classification Search ..... 118/668, 118/679, 686, 713, 306, 317, 318
See application file for complete search history.

(56) References Cited

U.S. PATENT DOCUMENTS

| | | | | |
|---|---|---|---|---|
| 3,452,709 | A | 7/1969 | Hartmeister et al. | |
| 3,452,710 | A | 7/1969 | Hentschel | |
| 3,726,711 | A | 4/1973 | Hogstrom | |
| 3,797,456 | A | 3/1974 | Hogstrom | |
| 3,971,336 | A | 7/1976 | Allen et al. | |
| 4,378,386 | A | 3/1983 | Rehman | |
| 4,605,351 | A | 8/1986 | Hatcher et al. | |
| 5,059,901 | A | 10/1991 | Van Voorhis | |
| 5,254,164 | A | 10/1993 | Masahumi | |
| 6,071,347 | A * | 6/2000 | Ogawa et al. | 118/679 |
| 6,379,464 | B1 | 4/2002 | Martel | |
| 2004/0003773 | A1 * | 1/2004 | Kato et al. | 118/317 |

FOREIGN PATENT DOCUMENTS

| | | |
|---|---|---|
| DE | 2600811 | 7/1977 |
| GB | 529216 | 11/1940 |

OTHER PUBLICATIONS

International Search Report for PCT/US03/014681.
Brochure "Weight Watchers Controlling Consistent Inside Spray Coating Weights", The Canmaker magazine, May 1994, Sayers Publishing Group, Ltd., Mark Novotny of Nordson Corp.

* cited by examiner

*Primary Examiner*—George R Koch, III
(74) *Attorney, Agent, or Firm*—Calfee, Halter & Griswold LLP

(57) ABSTRACT

A spray application system for applying material to a surface of a rotating body such as a beverage can includes a detector that detects the actual speed of rotation of the surface during a spraying operation. This allows a controller to adjust trigger signals for the application device to be adjusted based on speed of rotation to minimize overcoat. A laser sensor may be used as an example. The use of the speed detector also allows for partial wraps as well as full wraps of applying material to the rotating surface.

10 Claims, 9 Drawing Sheets

SURFACE ROTATION SPEED DETECTION IN SPRAY SYSTEMS

RELATED APPLICATION

This application is a continuation-in-part of International patent application number US03/14681 filed on May 12, 2003 for SURFACE ROTATION SPEED DETECTION IN SPRAY SYSTEMS, which claims the benefit of U.S. Provisional patent application Ser. No. 60/378,008 filed on May 13, 2002 for CAN ROTATION DETECTION AND SPRAY WEIGHT CORRECTION SYSTEM, the entire disclosures of which are fully incorporated herein by reference.

TECHNICAL FIELD OF THE INVENTION

The invention relates generally to apparatus and methods for spraying material onto a rotating surface. More particularly, the invention relates to spraying a surface of a rotating body as a function of or based on a detected speed of rotation of the body.

BACKGROUND OF THE INVENTION

Spraying a material onto the surface of a rotating body is commonly done. For example, interior surfaces of metal beverage cans are coated to preserve the flavor of the contents from being changed due to contact with a metal surface. A variety of spray systems have been developed over the years. In the can industry, can interiors are sprayed using one or more spray applicator devices having one or more nozzles positioned near the can interior. Material is sprayed onto the can surfaces while the can is rotated. Can surfaces may include interior and exterior surfaces.

In many applications it is important to assure that the entire surface is coated. The amount of material that is applied to a surface is usually measured in terms of coating weight. In an ongoing effort to reduce costs, coating weights have also been reduced. However, lower coating weights necessitate tighter control over the coating process. There are many process variables that affect coating weight, including temperature, pressure, viscosity, spray duration, nozzle flow rate and pattern control, and spray applicator position. In typical known rotating coating application systems, each deposition of material onto the circumferential surface of the container body is called a wrap. In a known can coating system, a can may be coated with a single wrap or two or more wraps.

The amount of material that is applied to a rotating surface is a function of the above noted process variables, the number of wraps, and also the rotation speed of the surface. If the rotation speed were always a known constant, then the amount of material applied to the surface could be better controlled within the ability of the manufacturer to control the other process variables. But in practice it is very difficult to maintain a constant speed of rotation of the surface being sprayed. As a result, the other process variables noted above have a much greater impact on the coating weight and completeness of each wrap. For example, the actual spray duration can have a major impact on the amount of coating material applied to the rotating surface as a function of the speed of rotation. Spray duration refers to the time duration that coating material impinges the surface being sprayed. Spray duration is thus affected by flow characteristics of material through the spray application device, material transport times and spray device turn on and turn off time delays. The turn on time delay refers to the time delay between the command to turn the spray application device on via a first trigger signal to the spray application device and the actual time that material begins to impinge the surface. Turn off delay refers to the time delay between the command to turn the spray application device off via a second trigger signal to the spray application device and the actual time that material stops impinging on the surface. If the rotation speed is not constant, the spray duration time greatly impacts the completeness of the wraps and the distribution of coating weight applied during each wrap.

In known can spraying systems, can rotation is effected by a suitable drive mechanism that spins the can or surface at an expected rate. There is a wide variety of such drive mechanisms, including but not limited to belt drive systems and vacuum chuck systems. Even though the drive motor or mechanism can be fairly well controlled for rotation speed, such speed data does not necessarily translate into a known rotation speed of the surface being sprayed. For example, in a belt drive system, a can is rotated by contact with a rotating belt. However there can be significant slippage between the belt and can. In vacuum chuck systems there may also be slippage between the can and the chuck. Moreover, precise control of the drive mechanism speed of rotation comes at a cost that adds to the overall cost of the spray application system.

Prior to our invention it is believed that rotating spray application systems have not taken into account the actual speed of rotation of the surface being sprayed. Rather, prior efforts have been directed to controlling the other process variables that affect coating weight, or attempting indirectly to control can rotation speed by controlling rotation speed of the drive mechanism. However, because actual surface rotation speed varies, and further because there are so many additional process variables that affect coating weight as a function of rotation speed, the surfaces must be overcoated to ensure that the requisite number of wraps is achieved. This overcoat of excess coating material can be on the order of about fifteen to about thirty percent or more, and results in a substantial waste of material being sprayed. Overcoat conditions also slow down the overall can processing time since more time is required to spray each can. Additionally, due to the overall lack of tight control of the various process parameters, known spray applications systems necessitate costly inspection requirements to visually or otherwise verify the quality of the coating wraps applied to the surface.

The need exists therefore to provide process and apparatus for applying material to a surface of a rotating body that overcomes or diminishes the aforementioned limitations of known systems.

SUMMARY OF THE INVENTION

The invention contemplates in one aspect a material application system for applying material to a rotatable body wherein the application time is controlled as a function of the detected actual rotation speed of the body. By detected "actual" speed of rotation is meant that the speed of the rotating body is directly detected, as contrasted to indirect detection from a rotation speed characteristic of the drive mechanism. In one embodiment, apparatus for spraying material onto a surface of a body includes a drive mechanism to rotate the body, a spraying mechanism to spray a surface of the body as the body rotates, and a circuit to control the spray mechanism as a function of speed of rotation of the body. In a specific embodiment, rotation speed of the body is detected directly by a non-contact sensor that detects a characteristic of the body as it rotates and converts that detection into a speed signal. In one form, the sensor comprises a laser detector that detects one or more markings on the body.

In accordance with another aspect of the invention, application of a material to a rotating surface is achieved by controlling an application mechanism based on detected speed of rotation of the surface. In one embodiment, an apparatus for applying material onto a surface of a rotating surface includes an application mechanism to apply material to a surface as the surface rotates, and a circuit to control the application mechanism as a function of actual speed of rotation of the surface. In one exemplary embodiment, actual speed of rotation is detected by a sensor that detects movement of one or more characteristics of the rotating surface.

In accordance with a method aspect of the invention, predictive control of a spraying mechanism is based on a determination of completion of one or more complete or partial rotations of the body as a function of the detected actual rotation speed of the body. In one embodiment, a spray application device is triggered on and off based on detecting the actual speed of rotation of the body so that material application to the body generally coincides with a predetermined number of rotations of the body, such as, for example, a selectable number of partial and/or complete wraps. In another method embodiment, a spray application device is triggered on and off for a predetermined time period based on detecting a minimum speed of rotation of the body. In still a further method embodiment, a spray application device is triggered on and off for a default time period based on failure to detect speed of rotation of the body.

In accordance with another aspect of the invention, a control system for controlling operation of a material application mechanism includes a non-contact speed detection arrangement that detects actual speed of rotation of a surface having material applied thereto by the application mechanism. In one embodiment, the speed detection arrangement includes a laser sensor that optically detects one or more markings on the rotating surface. The laser detector produces a signal that corresponds to speed of the rotating surface. This speed related signal is used by the control system to control operation of the material application mechanism.

In accordance with another aspect of the invention, alternative speed detection apparatus and methods are contemplated. These alternatives relate to use of a sensor other than a laser sensor. In an exemplary embodiment, an optical sensor may be used. In some applications the optical sensor can reduce cost and be less sensitive to alignment of the sensor relative to the rotating surface. The use of an optical sensor is based on detecting pattern changes on the rotating surface, for example, color patterns as may be present in a decorated can outer wall. Various signal processing and analysis techniques may be used to extract the speed information from the sensor output.

These and other aspects and advantages of the present invention will be readily appreciated and understood from the following detailed description of the invention in view of the accompanying drawings.

DETAILED DESCRIPTION OF THE INVENTION

1. Introduction

Figure 1:
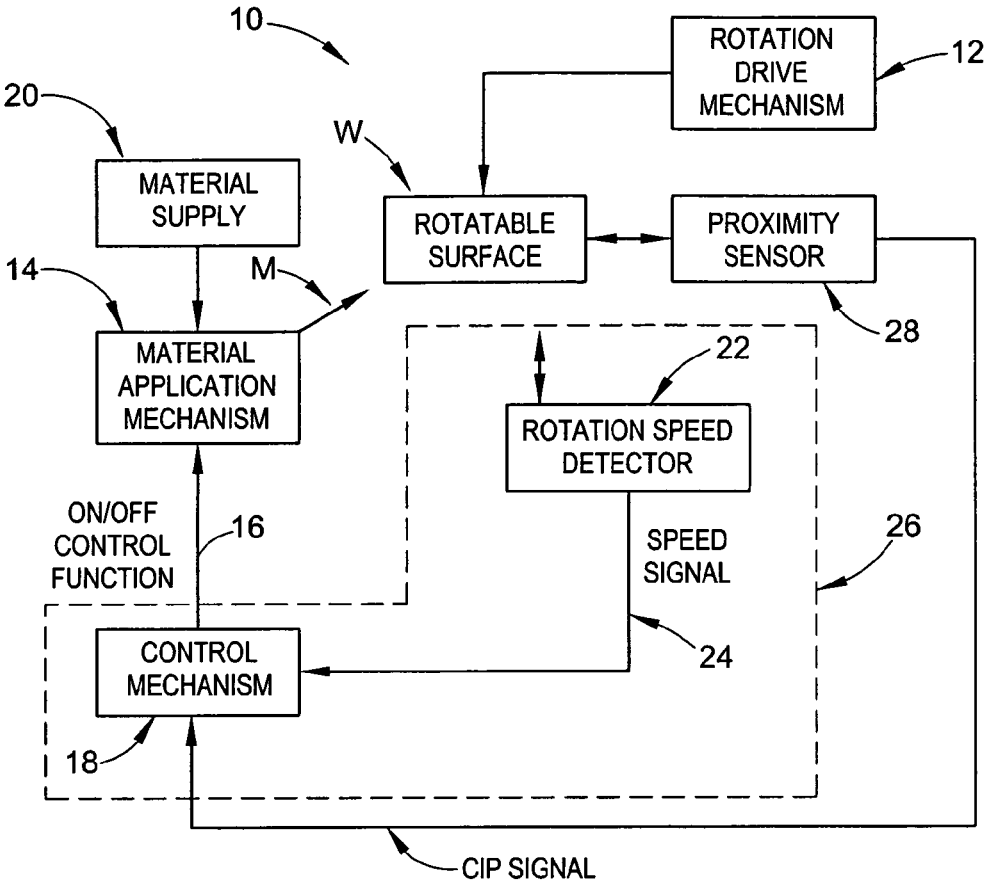
FIG. 1 is a functional block diagram of a material application system in accordance with the invention.

The present invention is directed to apparatus and methods for application of material onto a rotating surface. In accordance with one aspect of the invention, apparatus and methods are provided for controlling operation of an application mechanism that applies material to a surface of a rotating body based on a detected actual speed of rotation of the body. In an exemplary embodiment, the invention is illustrated herein for use with a spray coating process and apparatus for spraying a coating material, such as for example water and/or solvent borne coating material, to the interior surface of a rotating can body. For example, coating material may be applied to the interior surface of a two piece or three piece can body or outside dome spray.

While the invention is described and illustrated herein with particular reference to various specific forms and functions of the apparatus and methods thereof, it is to be understood that such illustrations and explanations are intended to be exemplary in nature and should not be construed in a limiting sense. For example, the present invention may be utilized in any material application system involving the application of material to a rotating surface. The surface need not be a can surface, and need not be an interior surface, but may include exterior surfaces, generally planar, curvilinear and other surface geometries, end surfaces, and so on. The application system illustrated herein is a spray application system, however the word "spray" is not intended to be limiting. The invention can be similarly applied to other application techniques such as deposition, coating, brushing and other contact and non-contact application systems, as well as for liquid and non-liquid coating materials. The surface being coated may be rotated by a number of different techniques and apparatus and the invention is not limited to any particular rotation technology. Thus, the invention is broadly directed to the concept of controlling an application mechanism that applies a material to a rotating surface based on a detected actual speed of rotation of the surface.

Additionally, various aspects of the invention are described herein and are illustrated as embodied in various combinations in the exemplary embodiments. These various aspects however may be realized in alternative embodiments either alone or in various other combinations thereof. Some of these alternative embodiments may be described herein but such descriptions are not intended to be a complete or exhaustive list of available alternative embodiments. Those skilled in the art may readily adopt one or more of the aspects of the invention into additional embodiments within the scope of the present invention even if such embodiments are not expressly disclosed herein. Additionally, even though some features and aspects and combinations thereof may be described herein as having a preferred form, function, arrangement or method, such description is not intended to suggest that such preferred description is required or necessary unless so expressly stated. Those skilled in the art will readily appreciate additional and alternative form, function, arrangement or methods that are either known or later developed as substitute or alternatives for the embodiments described herein.

It is important to note that the concept herein of detecting or determining speed of rotation of a surface does not necessarily mean that an actual speed "number" is determined, calculated or otherwise a necessary output, although the invention can certainly be realized with that as an output if so required for a particular application. In some applications it may suffice to be able to detect that the relative speed of the surface is below, at, or above a value without having to precisely determine for example the rpm number. Still further, precise speed information can be obtained using the invention without having to know or determine the actual speed number. For example, precise relative speed can be in most cases very useful information (for example, relative to a calibrated value). Thus the invention is broadly directed to determining knowledge or information about speed of rotation, whether or not the actual speed number is a part of the implementation.

2. Detailed Description of Embodiments of the Invention

With reference to FIG. 1, a material application system 10 for applying a material to a surface of a workpiece W includes a workpiece holder (not shown). In the illustrated embodiments the workpieces are cans. The workpiece holder is part of a can rotation drive mechanism 12 which may be any one of a wide variety of well known systems, both known and those later developed. Such systems typically use a star wheel to hold a plurality of cans to be sprayed. A can that is to be sprayed enters a pocket where it can be spun about the can's longitudinal axis by a drive belt or wheel or other suitable device. Typical drive mechanism 12 spin the cans at about 500 rpm to about 3000 rpm, but the present invention is not limited to any particular range of rotational speeds. Suitable examples of drive mechanisms that may be used with the present invention are described in U.S. Pat. Nos. 3,452,709; 3,726,711; 3,797,456; 4,378,386; and 5,254,164 the entire disclosures all of which are fully incorporated herein by reference. Further description of the drive mechanism is not required for a full understanding and appreciation of the present invention. With the present invention it is not a requirement that the drive mechanism spin the cans at a tightly controlled speed of rotation.

The application system 10 further includes a material application mechanism 14 that sprays or otherwise deposits or applies a material M to a surface of the rotating workpiece, typically the inside surfaces of a beverage can for example. The particular application mechanism or device 14 selected will depend on many factors including but not limited to the characteristics of the material being applied such as viscosity, flow rates, required spray patterns if any, temperature, pressure and so on. Any number of many different types of application devices may be used with the present invention. One such example is a spray applicator Models A20A or MEG or available from Nordson Corporation, Westlake, Ohio. However, those skilled in the art will readily appreciate that many different forms and types of application devices, both known and later developed, may be used with the invention. For the remainder of this disclosure we will often refer to the application mechanism as a spray applicator without intending to limit the invention to use of such a spraying device.

The application mechanism 14 operates in response to a number of control signals and functions, but the signal of primary interest to the present invention is the on/off control function 16. This control function is typically realized in the form of one or more electrical or pneumatic trigger signals that instruct the spray applicator 14 spray mechanism to turn on and off. The spray applicator 14 receives the control function 16 from a control mechanism 18. The control mechanism 18 may be realized, for example, as an electronic circuit in the form of any programmable digital or analog control circuit. Other control mechanism however, including mechanical controls, may be used in appropriate applications. The control functions of the control circuit 18 may include control of the spray applicator 14, the drive mechanism 12 and a supply 20 of material to the spray applicator 14. The supply 20 may be realized in the form of any of a wide variety of pump supply systems, for example, well known to those skilled in the art.

In accordance with the invention, a speed detector or sensor 22 is used to detect the actual rotational speed of the workpiece W. The detector 22 produces an output signal 24, typically an electrical signal, that has a characteristic that corresponds to rotational speed of the workpiece. This speed signal 24 is an input to the control circuit 18. It is preferred, although not required, that the detector 22 be a non-contact sensor as indicated by the double arrow heads in FIG. 1. This facilitates the ability of the sensor 22 to detect speed during an actual spraying operation. In one embodiment the detector 22 is realized in the form of a laser sensor that detects one or more marks or other indicia on the workpiece. However, other sensor technologies may be used including but not limited to optical sensors, proximity sensors and so on. An embodiment of the invention that is realized by the use of a color optical sensor is described hereinbelow.

The control circuit 18 is programmed to receive the speed signal 24 and to determine the speed of rotation of the can W if possible. It is possible that during a spraying operation the signal 24 could become distorted or interrupted. The control circuit 18 detects such occurrences and responds in a predetermined manner as described herein below. The control circuit 18 also receives a can-in-pocket (CIP) signal from a proximity sensor 28 or other suitable device that indicates the presence of a can to be coated.

It is desirable to minimize the residence time that the workpiece is in the pocket for a spraying operation. The lower the residence time, the higher will be the product throughput rate. Therefore, it is preferred though not required that the control circuit 18 determine the rotational speed of the can W in less than a single full rotation of the can. At the typical rotational speeds of the cans during spraying, the control circuit 18 will need to be capable of computing the speed, compensating the control function 16 for the detected speed, or selecting a default control function 16 when the speed cannot be determined, and executing these control functions in the minimum time needed to complete the desired number of wraps. Accordingly, it is preferred although not required that the control circuit 18 be realized in the form of a high speed processor such as utilizing DSP (digital signal processing) technology. The control functions are primarily mathematical therefore any suitable high speed computational processing technology can be used. However, in some embodiments such high speed processing will not be necessary, especially for example, in cases where the control circuit 18 need only detect a minimum rotation speed or when longer spray durations are involved. In such cases, lower processing speed controllers may be used.

The control circuit 18 with the speed sensor 22 form a control system 26 that can be incorporated into many can rotation spray application systems. By detecting actual speed of rotation and adjusting the on/off control function 16 accordingly, the control system 26 can minimize overcoat and reduce residence time of a can in the spray pocket. Therefore, the control system 26, and methods embodied therein, is considered to be a separate sub-combination of the overall system 10 that may be implemented in many different types of can rotation application systems.

The present invention contemplates a number of alternative control methods based on a detected speed of rotation of the workpiece W. Additional embodiments will be readily appreciated by those skilled in the art.

In a preferred control method, the control circuit 18 adjusts the spray applicator trigger on and trigger off signals based on the detected actual speed of rotation of the can surface to which material is to be applied. Using the detected speed, the control circuit 18 is programmed to predict when the selected number of wraps is completed so that the spray duration time terminates substantially at the completion of the desired number of wraps. This can only be done with high accuracy when the control circuit 18 is able to detect the actual rotation speed of the can. In a further optional enhancement, the control circuit 18 also takes into account, or in other words compensates, for the applicator open and close time delays.

In an alternative control method, the control circuit 18 detects that the can is rotating at least at a predetermined minimum speed. The control circuit 18 then applies a predetermined spray time control function 16 to the spray applicator 14. Because the control function 16 will be in the form of a predetermined spray time period, the control circuit 18 must detect that a minimum speed is achieved to assure that the desired number of wraps can be completed. The predetermined control function 16, for example, may be based on expected or average spray applicator open and close delays, as well as expected or average rotation speeds of the can. This data may be empirically obtained for example for each applicator or an average of a number of applicators. Thus, some overcoat may occur due to speed variations as well as individual applicator speeds, but the accuracy will still be far better than the prior state of the art.

Either of the above two control methods may optionally, and preferably, include a default spray time control function 16 which is used when rotation speed of the can, for whatever reason, cannot be detected. In such a case, the control circuit 18 simply applies a default time interval for spraying that insures adequate coverage even in the absence of actual rotation speed of the can data. This may be for example, the same time interval used in the prior art and will result in similar overcoat. But, the need to use the default timing may be determined on a can by can basis so that throughput need not be interrupted merely because for one or more cans, the actual speed could not be detected. However, when the default timing mode is used, an optional warning signal or other indicator may be generated to let an operator know that there may be a problem with speed detection.

The control circuit 18 may include memory for storing the various spray applicator time parameters for different models of applicators and materials being applied, or also an operator interface may be provided by which an operator may enter the parameters. Furthermore, the control circuit 18 may be separated from or integral to an overall control circuit for the drive mechanism 12.

Figure 4:
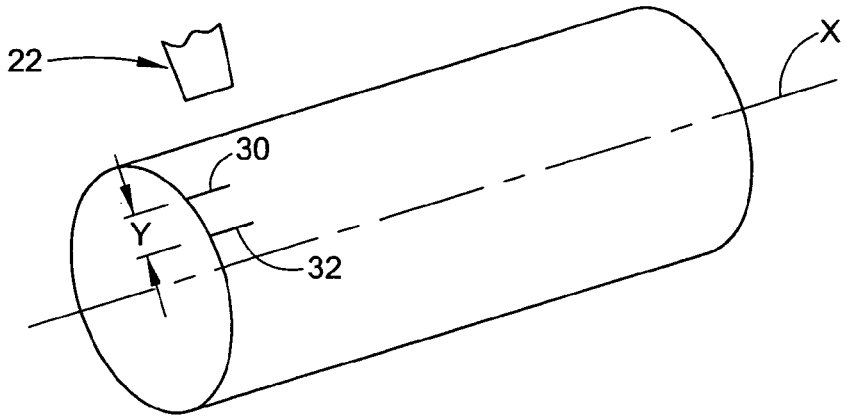
FIG. 4 is a perspective illustration of a can body with markings thereon for determining speed of rotation.

FIG. 4 illustrates a can W with two detectable indicia or marks 30, 32 thereon. As the can rotates about its longitudinal axis X, the marks 30, 32 will successively pass in front of the detector 22. The detector 22 produces a pulse or other signal that indicates detection of a mark. The time difference between the pulses thus corresponds to rotational speed of the can for a known distance Y between the marks. The distance Y may be expressed, for example, in radians or degrees or other suitable units.

The marks 30, 32 may take any form or shape provided they can be detected by the sensor 22. It is important to note that the precise location of the marks is not critical, but in the exemplary embodiment their relationship to each other is known. The marks may be applied to the cans or may be part of the can artwork. For example, a bar code could be used as the marks. Other technologies may alternatively be used to detect actual rotation speed of the can. For example, a proximity detector could be used to detect surface variations. An optical detector (such as those used with an optical mouse) could be used to detect speed of movement of optical patterns on the can, even irregular patterns, as described hereinbelow. Other technologies known or later developed may also be used as required.

At least two marks or detectable indicia are needed to detect speed in less than one rotation of the can. A single mark may be used with the invention but an entire rotation of the can will be needed before speed can be detected.

If a plurality of marks are uniformly spaced about the circumference of the can, then partial wraps can be applied. For example, if four marks are applied at 90 degree intervals, then wraps in ¼ increments can be realized. The number of marks will determine the resolution. For example, two marks spaced 180° apart will allow half wrap resolution, whereas 8 marks spaced 45° apart will allow ⅛ wrap resolution.

Figure 2:
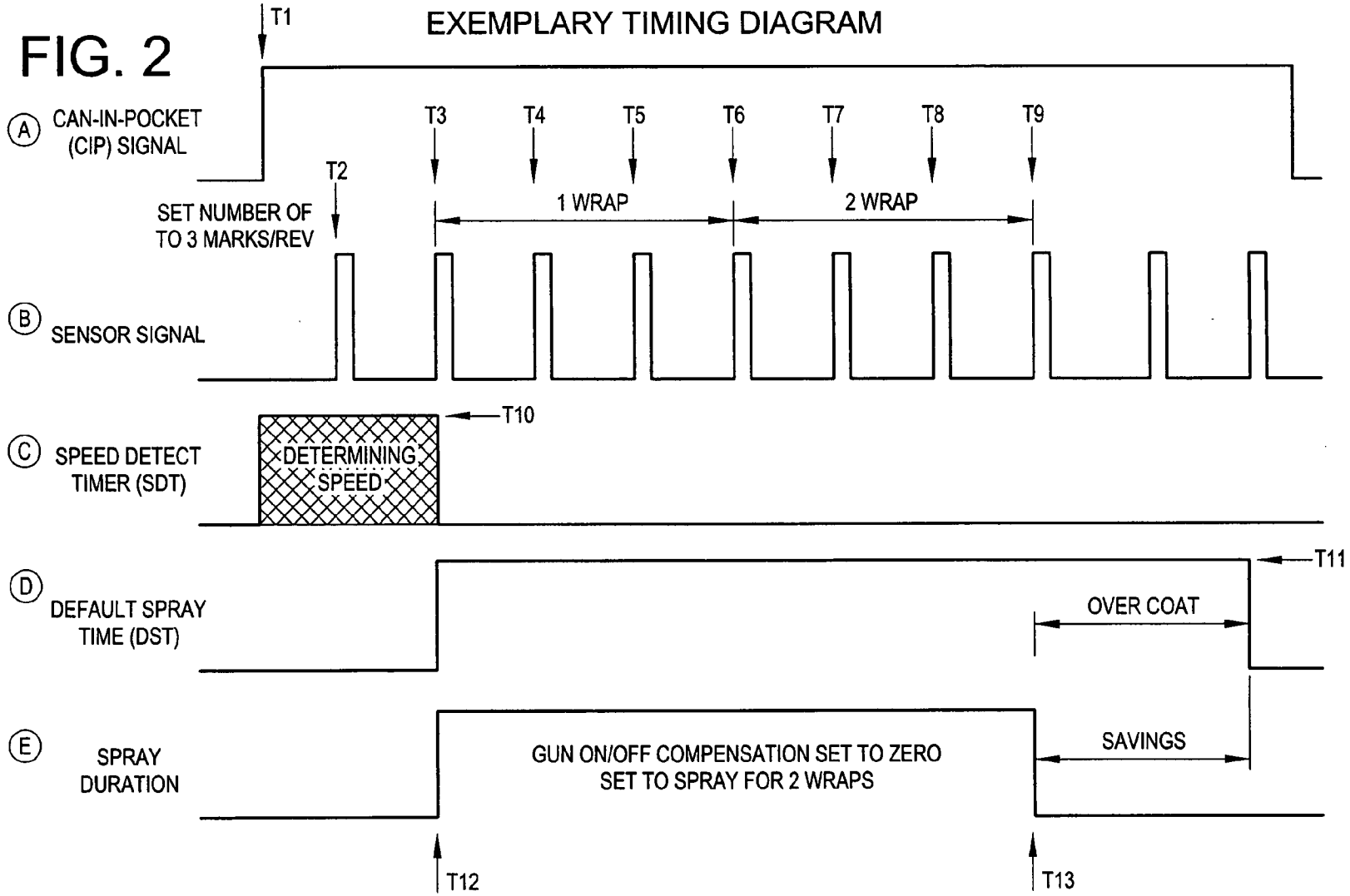
FIG. 2 is a timing diagram illustrating some of the basic concepts of the present invention.

FIG. 2 illustrates an exemplary timing diagram for the preferred control method of the present invention. The horizontal axis is time. Signal A is the can-in-pocket (CIP) signal which indicates at time T1 that a can is present for spraying. Signal B is the speed detector output signal. In this example, the signal B would be produced by using three marks equally spaced about the circumference of a can, meaning that every third mark detection corresponds to a complete rotation of the can relative to the first detected mark. It is important to note that the trace B is idealized in that the spacing of the pulses is illustrated as being equal, whereas in actual practice they would vary somewhat due to rotation speed variation.

In FIG. 2, T2 corresponds to detection of the first mark, T3 corresponds to detection of the second mark (two marks needed for speed detection) while T4, T6 and T6 correspond to the successive three mark detections during the first wrap following speed detection, and T7, T8 and T9 correspond to the successive three mark detections (following T6) during the second wrap. The example of FIG. 2 further assumes that two complete wraps are desired.

Trace C represents the Speed Detect Time (SDT) which is an internal timer function of the control circuit 18. The SDT is on the order of the prior art can spin-up time. This timer coincides with T1 or detection of the CIP signal. The duration of the timer is to T10 and corresponds to a sufficient time period to permit the control circuit 18 to determine the rotational speed of the can. The timer is shutoff after speed is detected, as illustrated in FIG. 2, so that T10 actually will extend longer if needed until speed is detected. It should be noted, however, that the system 10 may continue to update the speed determination during the spraying operation if so required. If the control circuit 18 is unable to determine the speed of rotation, then the control circuit 18 will execute a Default Spray Time (DST) duration represented by trace D. An error that speed could not be detected, or that the rotation speed is too slow, such as the above described warning signal, may optionally be generated at T10 as well. In the event that the rotation speed is too slow, the spraying operation on that can may be stopped, or alternatively completed but with the warning indication that the coating may not be adequate.

The DST duration begins at T3 and ends at T11. This time period is selected, as in the prior art, to ensure at least two wraps are completed. Thus, T11 necessarily extends beyond T9, where T9 is the time indication at the precise completion of two rotations, thus two wraps, of the can. If, as another example, three wraps were required, then T11 would extend past the time detection of the ninth mark detection.

Trace E represents an idealized on/off control function 16 in which the spray applicator is triggered on at T12 and off at T13 as part of the predictive control method. The trace is idealized in the sense that T12 exactly corresponds to T3 or after the can speed is detected and T13 corresponds exactly to T9 or the precise completion of two wraps. In actual practice, these gun trigger signals would not so precisely coincide with the marks because the control circuit 18 will be programmed to compensate for on and off delays of the particular spray applicator, temperature and pressure parameters and other selectable parameters that affect the actual spray duration. The time interval from T12 to T13 thus represents actual spray duration time (though idealized as noted in FIG. 2). It is evident from a comparison of Traces D and E a significant advantage of the invention. Trace D as noted essentially represents the prior state of the art in which the spray duration was not a function of actual speed of the can. Trace E shows that by using the invention, spray duration time can terminate precisely at the completion of the desired number of wraps. Thus, the shortened spray duration time between T13 and T11 represents the use of less material, less overcoat, and the resultant cost savings.

The illustration of FIG. 2 can also be used to understand the second control method alternative described herein. Recall in that method, the spray duration time is predetermined based on the spray applicator characteristics and other selectable parameters. This technique is especially useful when spray applicators are used that have fast turn on and or turn off times. In this method, the time T13 will not precisely coincide with T9 because some allowances or compensation will be needed to ensure two wraps are completed. But, since a minimum rotation speed of the can has been detected, T13 will only vary from T9 by an amount relative to the variation between spray applicators for turn on and turn offtimes. Thus, T13 will be much closer to T9 than would T11, still representing a savings. As in the preferred method, if a minimum speed is not detected the DST can be used.

It should be noted that the speed duration function may be used to detect when the speed of rotation is too high, or outside a desired speed range. Excessive speed of rotation can also affect coating quality.

The control circuit 18 may be programmed or input with appropriate data relating to the spray applicator on/off compensation times (typical gun on and gun off delay times are not equal to each other), temperature, pressure, viscosity, and so on depending on the desired spray accuracy. This data is used by the control circuit to calculate the required adjustments to the applicator trigger signals as a function of the actual speed of rotation of the can. The control circuit 18 thus in effect uses the various control parameters and detected speed to predict when the spray applicator must be triggered off so that the spray duration time interval ends at the completion of the desired number of wraps, and partial wraps if the latter option is used as well.

Figure 3:
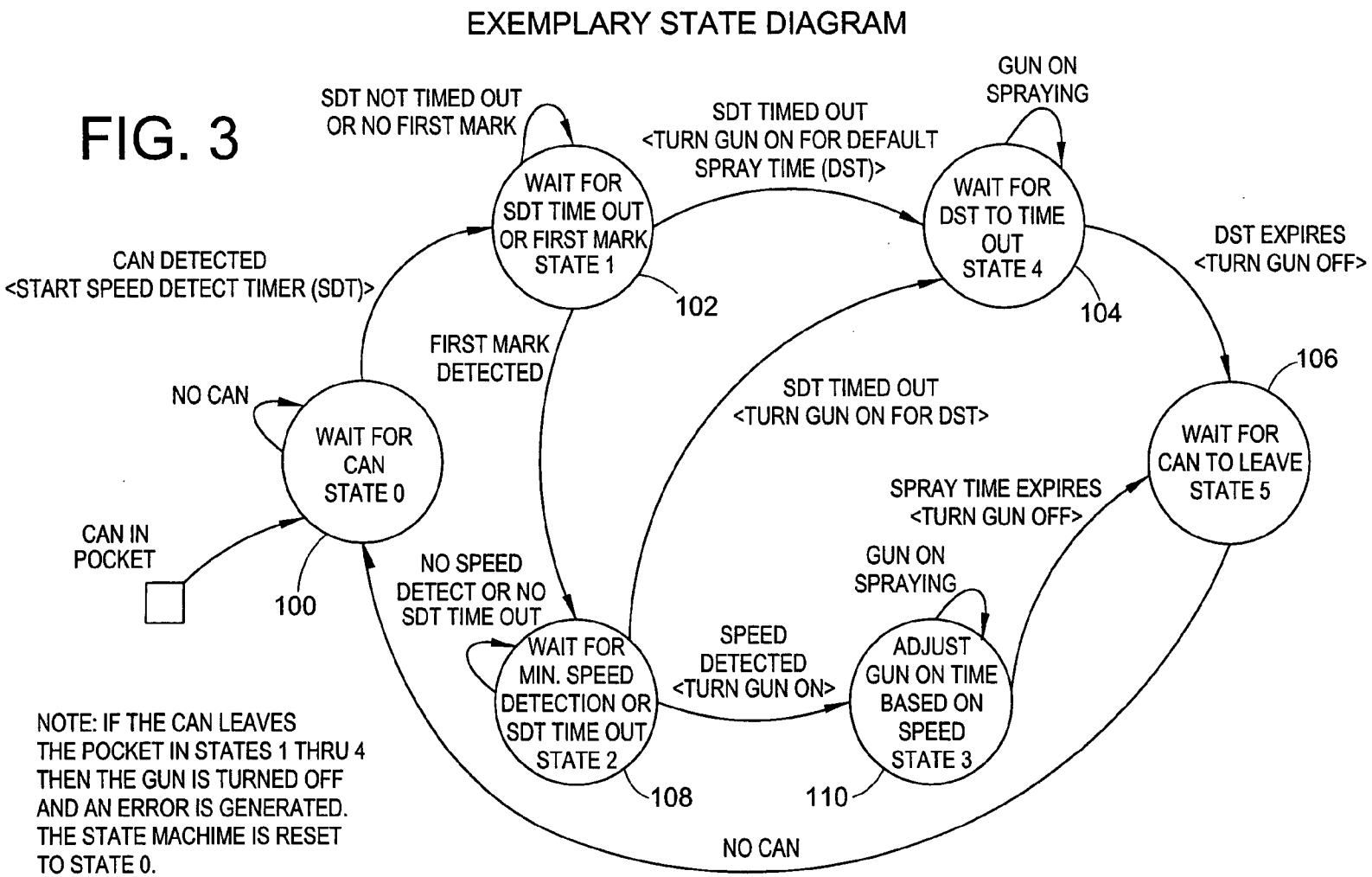
FIG. 3 is a state diagram for a control program suitable for use with the system of FIGS. 1 and 2.

FIG. 3 illustrates an exemplary state diagram for a control program suitable for use with the present invention with the control circuit 18. At step 100 (state 0) the system waits for the can-in-pocket (CIP) signal, upon receipt of which the SDT timer is started (Trace C, FIG. 2). At step 102 (state 1) the system waits for detection of the first mark or timeout of the SDT. If at state 1 the SDT expires the system branches to step 104 (state 4) and the spray applicator is turned on and the spray duration is set to the DST.

At step 104 the system waits for the DST timer to expire and turns the gun off, after which the system advances to step 106 (state 5) where the system waits for the can to leave the pocket (indicated by an absence of the CIP signal) and then returns to state 0.

At state 1 if the first mark is received before the SDT expires, the system advances to step 108 (state 2). The SDT is still running and the system attempts to determine the rotational speed of the can by detecting the one or more marks as the can rotates. If the system is unable to determine speed before the SDT expires, the system turns the applicator on and starts the DST, and branches to step 104 and follows the sequence from state 4 on as described before, meaning that the DST is used. If at state 2 the speed is determined, the applicator is turned on system advances to step 110 and then to 106. During step 110 (state 3) the system adjusts the spray applicator duration as a function of the speed of rotation. These adjustments include the applicator on delay compensation time and the applicator off delay compensation time. When the applicator time expires at state 3 the applicator is turned off and the system advances to state 5 and completes the loop as described above. Thus, when the actual speed of rotation of the can is able to be determined, the system adjusts the on/off control function 16 so as to appropriately trigger the spray applicator on and off so that the spray duration closely matches the number of wraps selected and ends at the occurrence of the final detected mark that corresponds to the completion of those wraps thereby avoiding overcoat.

The state diagram of FIG. 3 is also suitable for the second alternative method described herein above. In such a case, at step 108 the system will determine that a minimum speed has been attained, and at state 3 will adjust the timers to load the correct DST. Since the DST duration is fixed and not adjusted for speed, a small amount of overcoat may occur but will still be substantially less than the prior state of the art.

Figure 5:
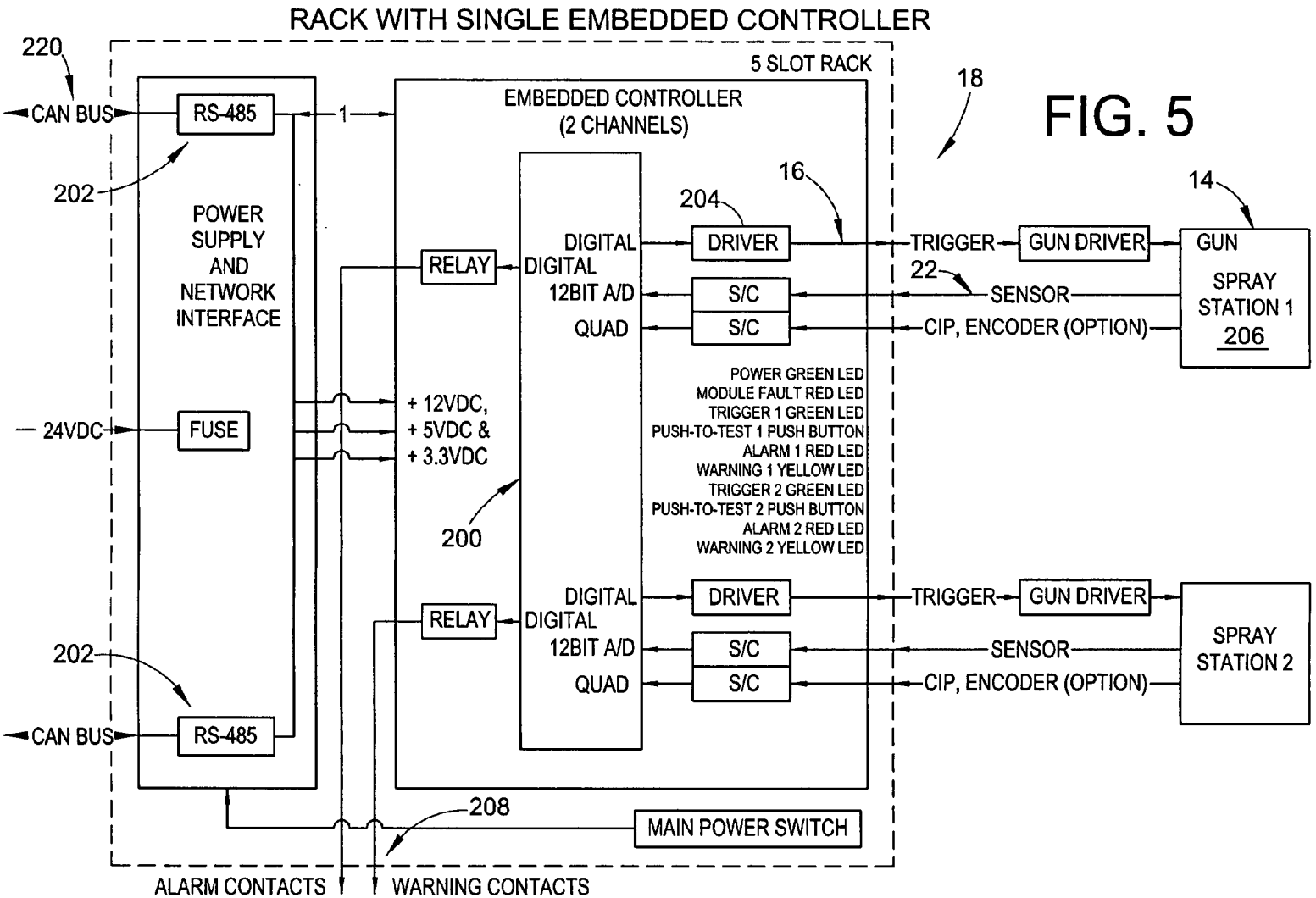
FIG. 5 is a functional block diagram of a control circuit suitable for use with the present invention.

With reference to FIG. 5, the control circuit 18 as noted can be implemented in many different ways. One such way is through the use of a DSP controller 200, such as part no. DSP 56F807 available from Motorola/Freescale. The DSP controller 200 is programmed using conventional and well known programming techniques. The controller 200 receives user inputs if available such as through a CAN (Controller Area Network) bus interface 202. Other input and communication techniques may be used as required and are well known to those skilled in the art. In the exemplary embodiment of FIG. 5 a single DSP controller has enough power to operate two spray stations, however, this configuration is not a requirement. Since both channels are identical only one need be described.

The controller 200, through a driver 204, provides the on/off control function 16 in the form of electrical trigger signals to the spray applicator 14 positioned at a spray station 206. The system 18 receives the speed sensor 22 output signal as well as the CIP signal. A position encoder may optionally be used as is known. The controller 200 also produces an optional alarm and warning signals 208 in the event of various detected faults such as failure to detect speed, failure to attain minimum speed, absence of detected marks and so on at the option of the user.

Figure 6:
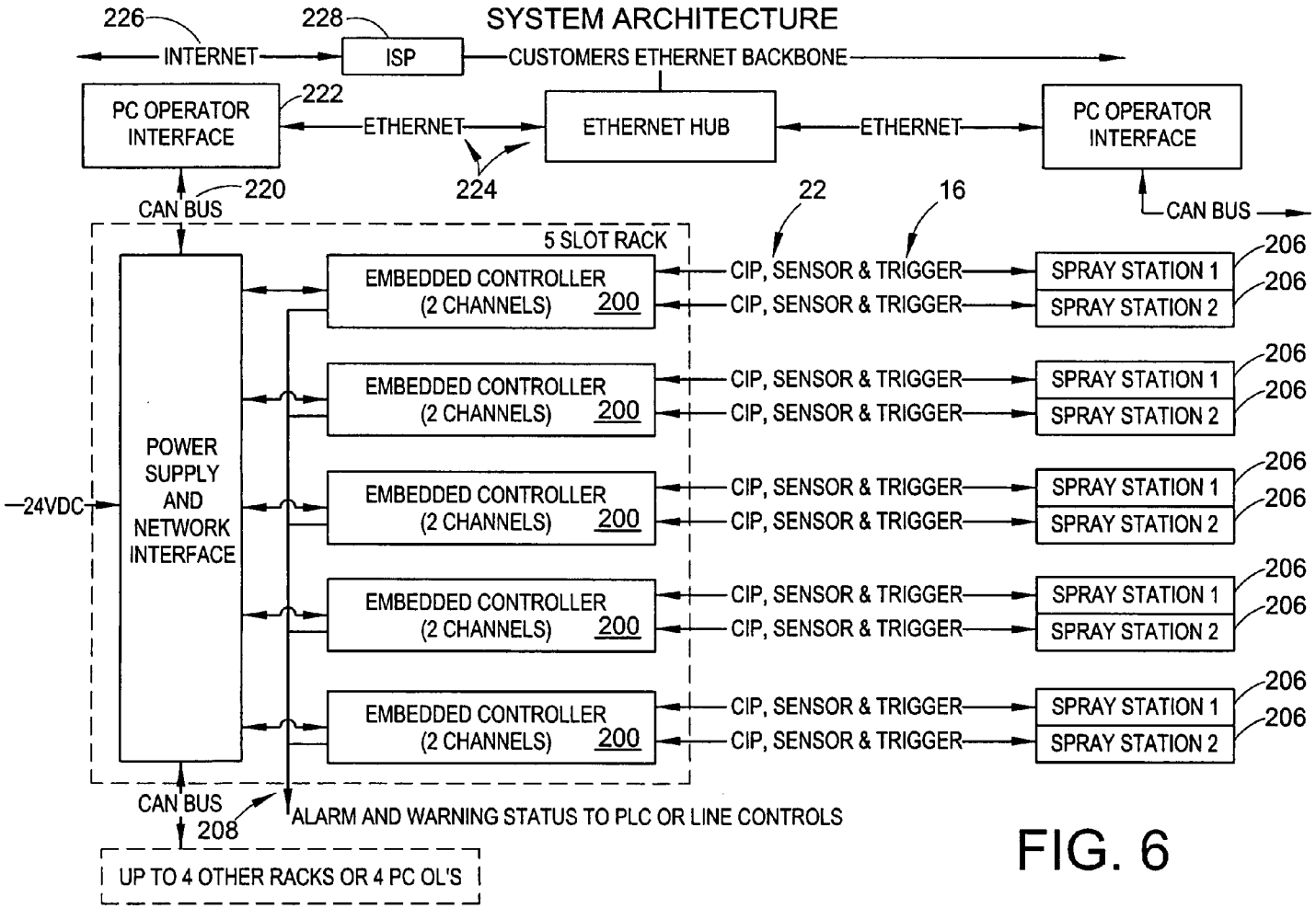
FIG. 6 illustrates a system level hardware architecture for a spray application system utilizing the present invention.

Since typical can manufacturing plants operate a number of such spray stations, it is further contemplated that a number of two channel controller subsystems 18 such as that illustrated in FIG. 5 can be networked together such as through a standard CAN communication protocol and bus 220, and further that the CAN bus 220 may be connected to a user interface 222 such as a PC and keyboard or other input device. The user interface 222 may further be networked over a standard Ethernet system 224 as well as through the Internet 226 via an Internet Service Provider (ISP) 228 or dedicated server. This system level architecture is illustrated in detail in FIG. 6.

3. Detailed Description of Alternative Embodiments of the Invention

Figure 7:
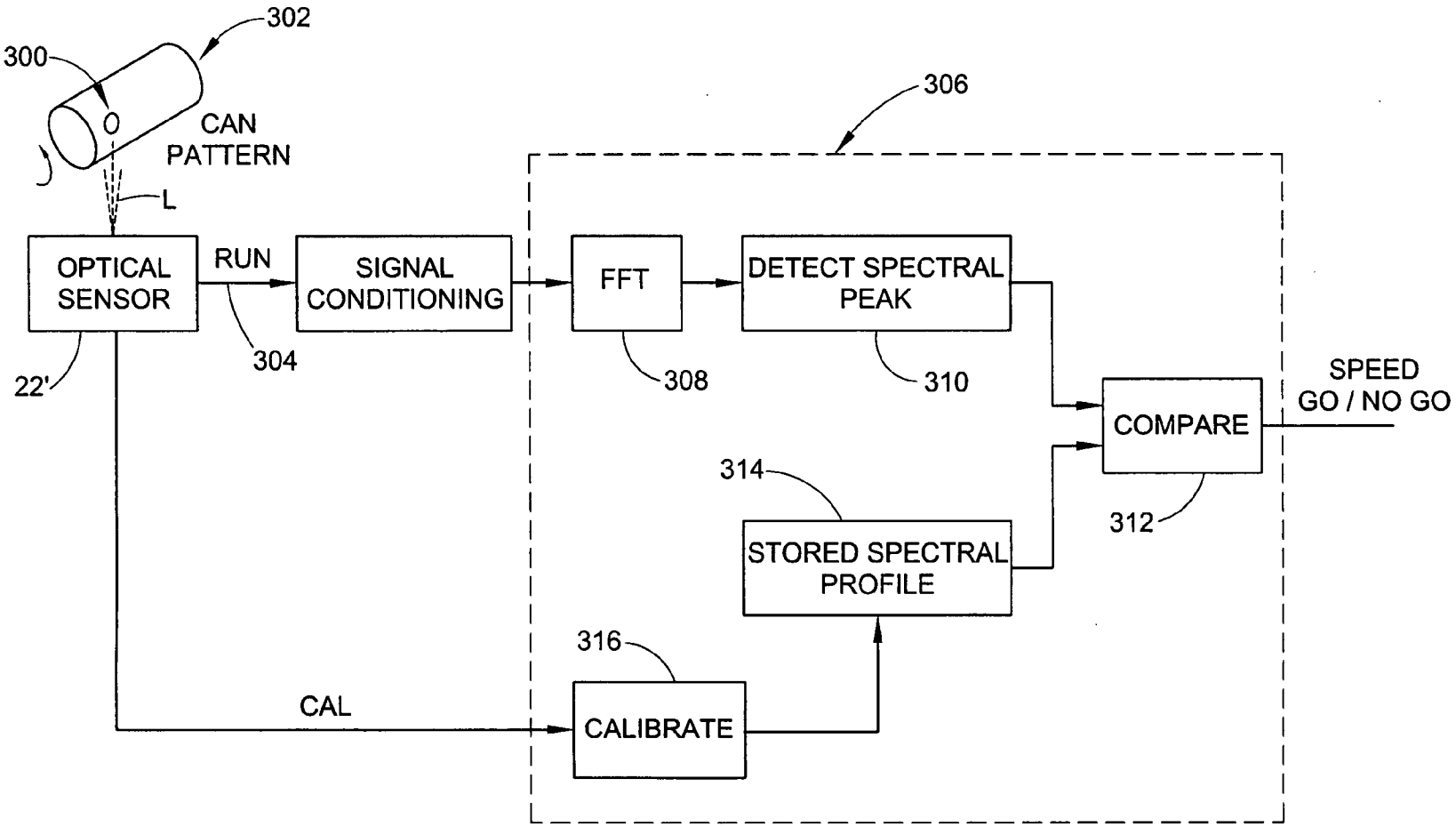
FIG. 7 illustrates a functional block diagram of an alternative embodiment of a speed detection apparatus using an optical sensor.

With reference to FIG. 7, we have further found that in some spray application systems the laser sensor can lose effectiveness due to alignment difficulties with the markings on the can, particularly when the can is rotating within the pocket. The laser source can in some instances present a vision issue. Additionally, it may be difficult or not cost effective for some customers to add special markings to the can that are detected by the laser sensor.

In accordance with another aspect of the invention, an optical sensor 22' is used to detect rotation of the can and produce a signal or output related to a pattern on the can. An optical sensor is less sensitive to alignment issues, does not require special markings and does not present any vision safety issues. In one embodiment, the optical sensor 22' is realized in the form of a three color sensor that produces three outputs each related to a specific color or wavelength, such as for red, blue and green. Grey scale sensing may alternatively be used. The optical sensor 22' output corresponds to pattern variations on the surface being scanned, such as color variations that are present on decorated cans. Alternatively the optical sensor can also be used to detect markings on the can as in the above-described embodiments.

The optical sensor 22' of the exemplary embodiment produces a small visible dot or sensing area that is directed onto the can surface. Other sensors may or may not produce a visible sensing area depending on the technology of the sensor. The visible dot helps verify alignment of the sensor with the can. A typical dot is about 0.25 inches in diameter but the actual dot size used will be a function of the selected sensor and the distance of the sensor from the can surface. The optical sensor may conveniently be disposed within the pocket that receives the can for rotation. The sensor produces an output, for example a voltage signal, that corresponds to an average color or wavelength within the region of the dot. As the can rotates, the sensor will detect variations in color due to various decorations on the can.

When a sensor is used that is capable of sensing two or more colors, the respective outputs can be logically AND'd to increase the number of repeating patterns being detected. This can increase the overall accuracy of the sensor output, however, those skilled in the art will appreciate that the invention may be realized with a single color (including gray scale) sensor provided that the sensor will detect the color pattern variations on the surface of interest.

An example of a suitable sensor is color sensor XURC4NPML2 available from Telemecanique and also available through Square D. A fiber optic cable may be used to couple the light pattern from the impinging dot back to the sensor.

As the can rotates, the color pattern will be detected by the sensor 22' and the sensor output will be characterized by a series of pulses or a pulse train corresponding to when a portion of the can surface having the appropriate wavelength pattern passes through or is exposed to the impinging dot. Even though the pattern on the can is stable, speed variations, vibration and simply the fact that the sensor output is an average signal from the dot illuminated region, the sensor 22' output will tend not to be a stable repeating signal in the time domain. In other words, simply observing the output signal as voltage versus time will show a signal that does not have steady repeatable edges, but rather the signal will appear to jitter.

We have discovered that even though in the time domain the sensor 22' output may not in all cases be particularly useful, if that signal is converted to the frequency domain a very useful output is produced. For example, by applying a fast Fourier transform to the sensor output a well defined peak occurs in the frequency domain. While this peak frequency itself may or may not correspond precisely to the rotation speed, the peak varies in frequency directly in relation to changes in speed of rotation. Therefore, a simple calibration process can be used to determine a nominal peak frequency and then this value can be compared to the measurement of an actual can rotation during a spraying operation to detect either speed changes or a simple go/no go event.

The optical sensor may be used to detect color patterns, such as decorative designs, on the rotating surface or can be used to detect applied markings as in the above embodiments. By using the can decoration or color scheme, no special markings are needed to be applied to the can. The scanned pattern may even be entirely random because it will repeat itself to the optical sensor as the can rotates, thus producing a primary spectral peak in the frequency domain. For random pattern detection using frequency domain analysis, two full rotations will typically be used to determine speed. If special markings are applied to the can then the above described encoder methods may be utilized for increased accuracy and calibration.

By 'optical sensor' is simply meant a sensor that operates from other than a coherent single wavelength of light such as a laser operates. The concept of a color sensor is intended herein to include gray scale as well as other spectral frequencies.

With reference to FIG. 7, the optical sensor 22' produces a beam of light L that forms a dot 300 on the surface of interest, such as the outside surface of a can 302. The optical sensor 22' may have one or more detectors that each detects a color, such as red, green, blue and so on. As the can rotates, the dot 300 will illuminate a changing color pattern (presuming the can is not a single uniform color). The sensor 22' output 304 is thus a time based voltage that pulses in accordance with whether the sensor is detecting the particular colors it is sensitive to. Using multiple color detection can increase the flexibility of the apparatus but is not required. It is also important to note that in some cases the optical detector can be used to simply detect any surface characteristic that causes a change in the sensor output, somewhat like an optical mouse can detect small and visually imperceptible variations in a surface to detect movement of the mouse across the surface. Thus, the invention contemplates either color pattern variations or any other pattern recognition on the surface of interest that is a stable pattern for purposes of detecting speed of rotation of the surface.

The sensor output 304 may be conditioned by conventional signal processing circuits for input to a processor function 306. The conditioning circuit may not always be required depending on the compatibility between the sensor output and the processor function, or may be incorporated into the processor function 306. In any event, the processor function 306 is used to apply an analytical tool, such as for example fast Fourier transform (FFT) analysis based on magnitude to the sensor output signal which is a time domain signal such as a pulse train. Other FFT techniques may be used as required other than magnitude based.

In the exemplary embodiment the processor function 306 is realized in the form of a conventional digital signal processing circuit (DSP) that can perform high speed mathematical calculations such as FFT. The DSP circuits are well known and need not be described in detail. A suitable device is model DSP56F807 available from Motorola/Freescale. This processor is conveniently programmable as is well known to this skilled in the art. Those skilled in the art will readily appreciate that the invention can be realized with many different circuits that carry out the processor function 306 and is not limited to DSP.

The processor function 306 includes, as it pertains to the present invention, an FFT routine 308 that converts the time domain sensor output 304 into a spectral or frequency domain signal. The spectral response will exhibit a peak frequency that is stable and directly relatable to speed of rotation of the can. The processor function 306 thus executes a peak frequency detection function 310 which is a first input to a compare function 312. Since the peak frequency may or may not be directly translated into actual speed, the concept of interest is that the peak frequency varies with speed, therefore by comparing the detected peak frequency to a baseline or calibrated value, any shift in the peak frequency can be detected so that changes in speed are known relative to the calibration speed. This provides a very simple way to implement a go/no go function or also can be used to more precisely determine the varying speed of rotation.

The processor function 306 thus includes a stored spectral profile 314 that is used as the other input to the compare function 312. For example, the stored profile may provide a calibrated peak frequency value at a nominal speed such as 2000 rpm. This calibrated peak frequency may be determined using a calibrate function 316. During calibrate, the peak frequency is detected for a known speed of rotation of the can surface. Various peak frequencies may be stored for different can profiles or for different rotation speed for example. Software can be programmed to initiate a calibrate sequence, for example, at the beginning of a shift or whenever different can patterns are being scanned.

Calibration can be implemented in a variety of ways. For example, an in-line or in-process/on machine calibration technique can be used for a go/no go calibration scheme. In this technique, an operator enters a speed value, or stores the spectral information as being related to a data point for the machine operating at that "speed", which speed value may be real or estimated. A selected number of cans are test run and the spectral responses are stored and/or analyzed to select a calibrated peak frequency that most closely matches the number of test runs. This frequency can then be used as part of a simple go/no go criteria for subsequent cans run during that shift or operation period. This calibration technique is a somewhat less precise calibration because the entered speed may or may not be an accurate number. But for a go/no go criteria, the information of interest is whether on a relative basis the machine is still operating at that calibrated "speed" even if the speed value was an estimate. The on machine calibration is typically more limited in terms of precision because the operator is basing the calibration on the actual machine performance without the ability to separately and independently identify the actual speed of operation. But for a basic go/no go performance criteria the technique will be accurate and useful.

A more precise calibration process can be implemented as well. In this technique, the test runs are performed off machine such as on an apparatus that has precise speed control. This speed information can then be associated with the various test runs of spectral data to determine the best match of peak frequency. Moreover, spectral patterns may be obtained at different rotational speeds to provide more accurate speed determination if so desired. This technique can also be used for a go/no go calibration as well. The calibration data can then be stored for use in the apparatus during actual production runs.

In another calibration technique, precise on machine calibration can be performed so long as the operator is able to precisely know the speed of rotation of the can surface when the spectral information is being collected during the test runs.

If the measured peak frequency is anything other than the calibrated value, then it is known that the can surface is not rotating at the nominal speed, and the frequency shift will not only indicate whether the can surface is rotating faster or slower than the nominal value but can also be used if required to determine the speed of rotation as the frequency shift is directly related to the rotation speed.

Figure 8A:
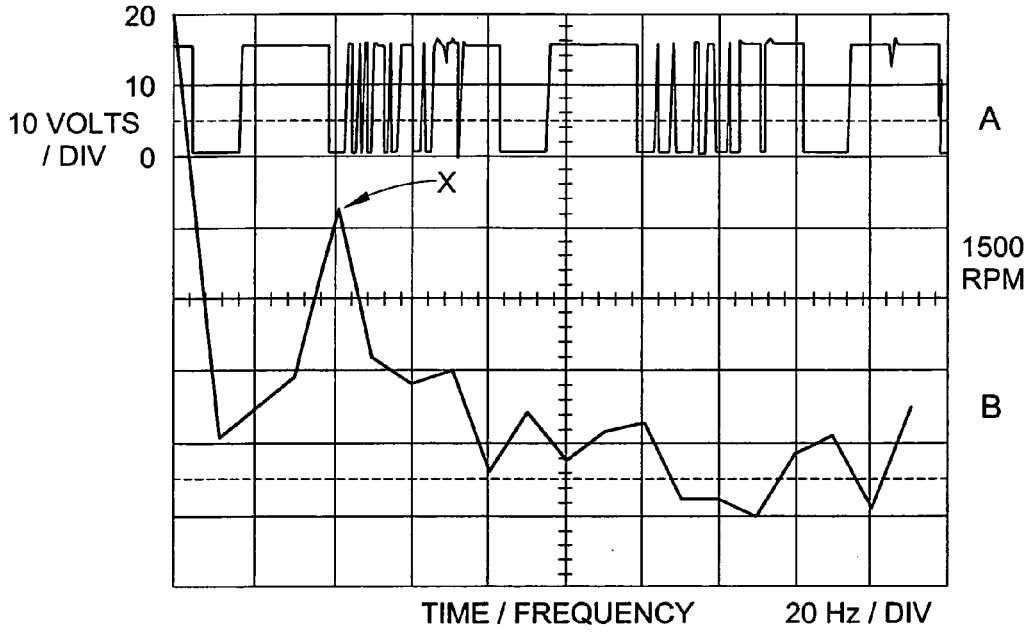
FIGS. 8A-8E are a series of charts showing optical sensor output signals and Fourier transforms at different rotational speeds of a decorated surface.
Figure 8B:
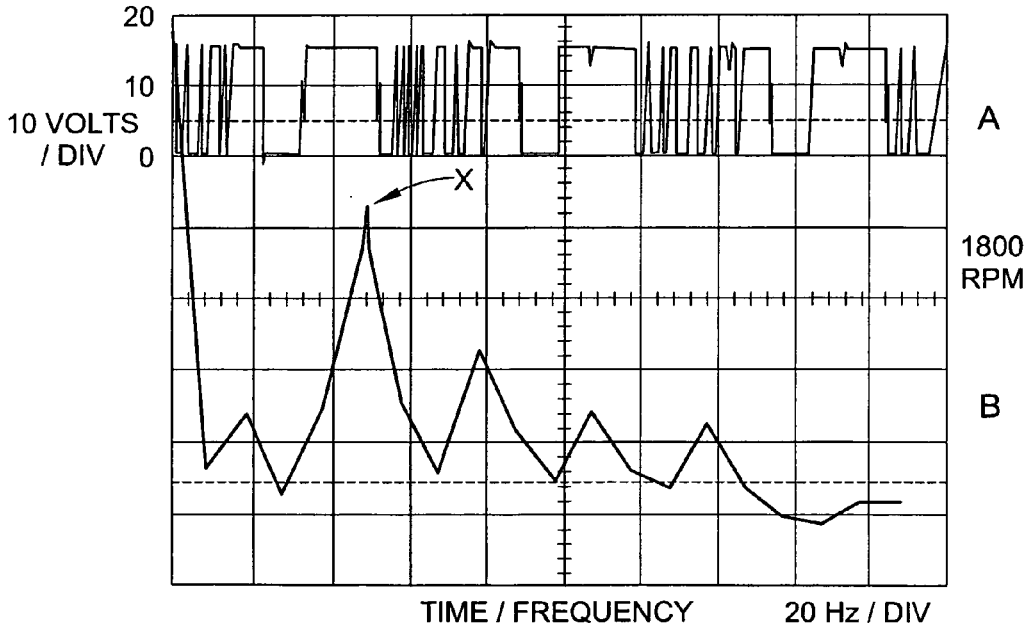
Figure 8C:
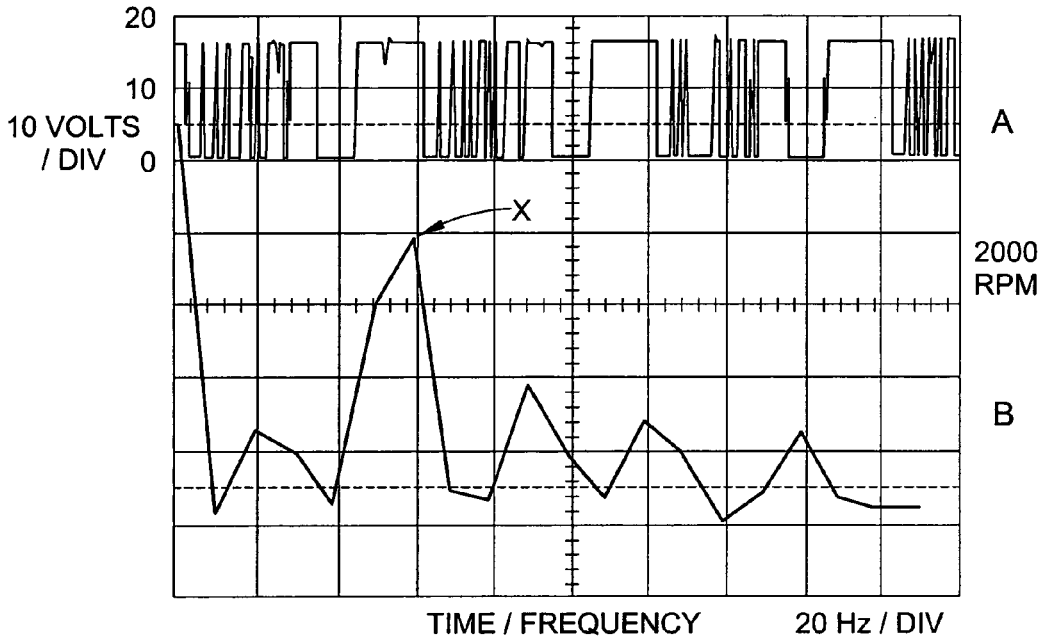
Figure 8D:
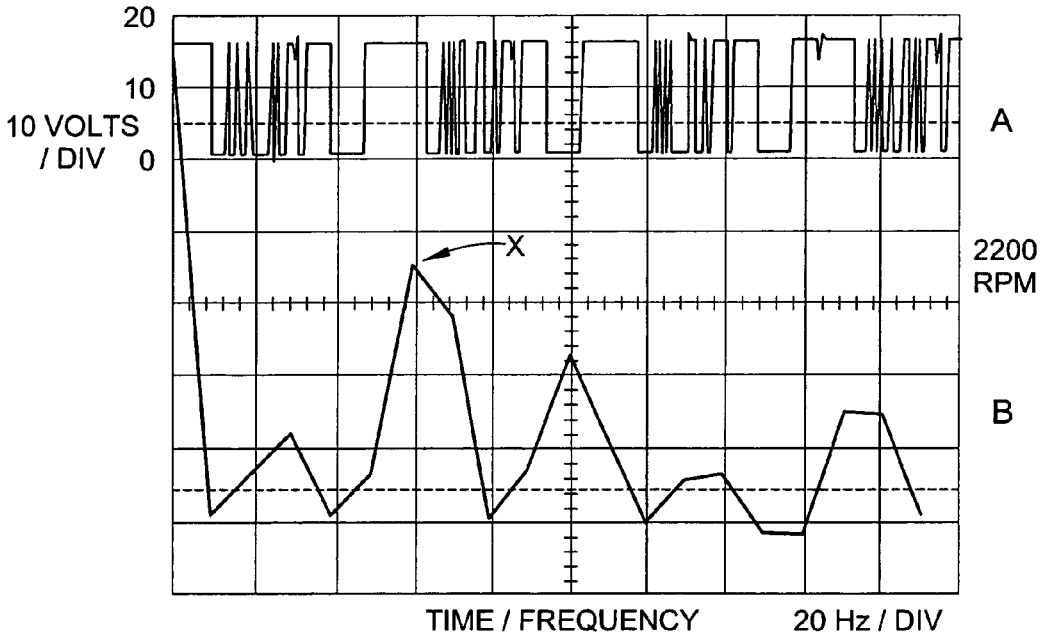
Figure 8E:
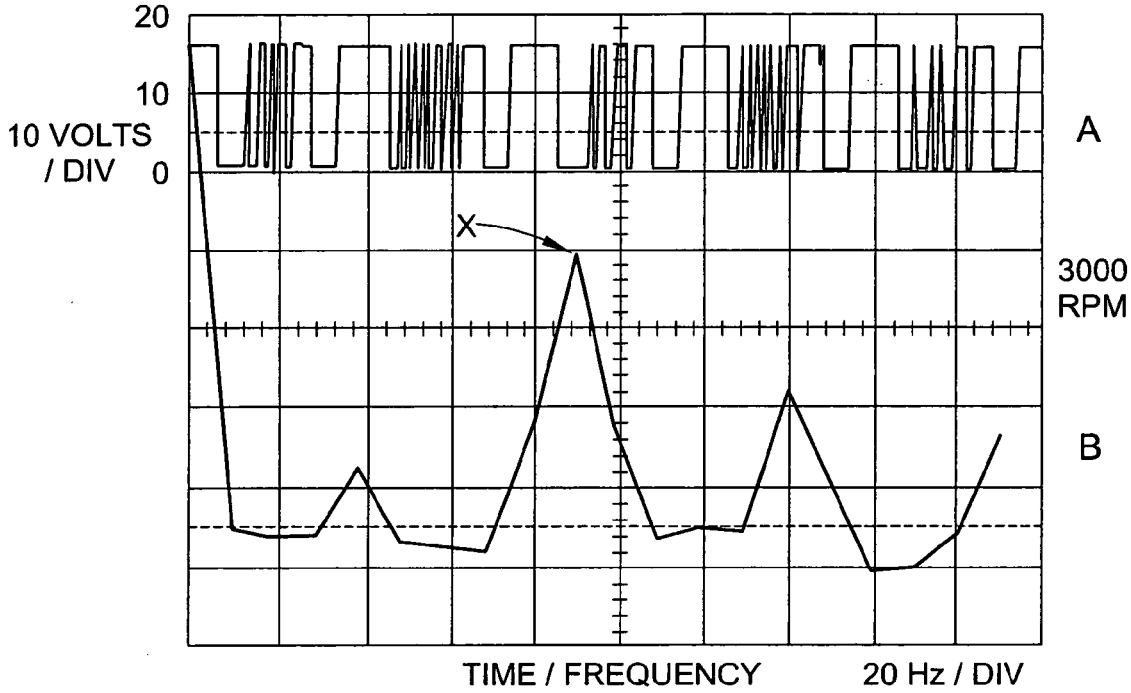

FIGS. 8A-8E illustrate the concept. The charts each include an upper trace A that is the sensor output voltage signal 304 and a trace B that is the FFT spectral signal of that sensor output. This date is shown for incremental rotation speeds of a decorated rotating can surface. If we allow 2000 rpm to be a nominal speed (the nominal speed can be selected as needed for a particular system), then FIG. 8C shows a peak frequency at point X. FIG. 8A is data at 1500 rpm, FIG. 8B is at 1800 rpm, FIG. 8D is at 2200 rpm and FIG. 8E is at 3000 rpm. What is immediately notable in comparing the peak frequency X for each spectral chart is that the peak frequency, regardless of its numerical value, changes directly with speed of rotation of the can surface. It should also be noted that the time domain output trace A in real time analysis exhibits pulse edges that may jitter considerably, thus indicating that the color pattern variations, probably due to there not being sharp delineations, cannot be used as precisely in the time domain as encoder pulses as in the above embodiments.

However, some can or other surface patterns may have sharp or otherwise well delineated color patterns or other delineations which would allow an optical sensor to produce a stable output in the time domain. This would allow an optical sensor to be used so as to obtain advantages over a laser such as less sensitivity to alignment and vision safety.

As in the earlier described embodiments, the invention provides various techniques for detecting directly the speed of rotation of the surface of the can, and not simply a detecting indirectly the surface speed by detecting speed such as of the drive motor, gears and so on. This greatly increases the accuracy of the spray application process to reduce wasted overspray.

For FIGS. 8A-8E, as an example, the spectral response at 2000 rpm may be stored as the calibrated value for comparison to the measured peak frequency during an actual run. A separate spectral response may be saved, for example, for each color detection.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

Having thus described the invention, we claim:

1. Apparatus for spraying coating material onto an interior surface of a rotating can body, comprising:

a spray applicator for spraying coating material onto the can interior surface as the can body rotates;

a sensor that optically detects actual rotation speed of the can body by optically sensing a characteristic of a rotating surface of the can body;

a control circuit that determines the number of rotations of the can body during a time period based on said detected actual speed of rotation of the can body;

and said control circuit controlling said spray applicator to spray coating material onto the can interior surface during a predetermined time period that corresponds to number of rotations of the can body.

2. The apparatus of claim 1 wherein said sensor optically detects actual rotational speed of the can body.

3. The apparatus of claim 1 wherein said sensor comprises a non-contact sensor.

4. The apparatus of claim 1 wherein said sensor comprises a laser sensor that detects a marking on the can body during rotation of the can body.

5. The apparatus of claim 1 wherein said sensor detects at least two markings on the can body.

6. The apparatus of claim 1 wherein said control circuit controls trigger on and trigger off signals of said spray applicator by determining completion of one or more rotations of the can body as a function of the actual rotational speed of the can body.

7. The apparatus of claim 1 wherein said control circuit controls actuation of said spray applicator for at least one complete rotation and an additional partial rotation of the can body.

8. The apparatus of claim 1 wherein said control circuit controls said spray applicator with a predetermined application period when actual speed of rotation of the can body cannot be detected.

9. The apparatus of claim 1 wherein said rotating surface comprises an exterior surface of the can body.

10. The apparatus of claim 1 wherein said number of rotations corresponds to complete rotations, partial rotations or both.

* * * * *